United States Patent [19]

Olson

[11] 4,198,042

[45] Apr. 15, 1980

[54] PADDLE TENNIS COURT AND DECK CONSTRUCTION

[76] Inventor: George E. Olson, 28 Malapardis Rd., Morris Plains, N.J. 07950

[21] Appl. No.: 861,307

[22] Filed: Dec. 16, 1977

[51] Int. Cl.[2] ..... E04B 5/43

[52] U.S. Cl. ..... 272/3; 52/483; 52/484; 105/422; 273/29 R; 403/405

[58] Field of Search ..... 272/3; 273/29 R; 52/584, 483, 588, 471, 470, 464; 24/263 A, 81 CC; 403/387, 405, 384; 105/375, 422

[56] References Cited

U.S. PATENT DOCUMENTS

| | | | |
|---|---|---|---|
| 2,080,916 | 5/1937 | Hayden | 52/690 |
| 2,813,310 | 11/1957 | Harrison | 52/226 |
| 3,062,339 | 11/1962 | Geyser | 52/460 |
| 3,257,134 | 6/1966 | Boyd et al. | 52/483 X |
| 3,935,687 | 2/1976 | Vaughn et al. | 52/483 |

FOREIGN PATENT DOCUMENTS

| | | | |
|---|---|---|---|
| 662763 | 12/1951 | United Kingdom | 52/584 |
| 739400 | 10/1955 | United Kingdom | 105/422 |

*Primary Examiner*—Richard C. Pinkham
*Assistant Examiner*—Arnold W. Kramer
*Attorney, Agent, or Firm*—Richard C. Woodbridge

[57] ABSTRACT

The deck of a paddle tennis court includes a plurality of extruded aluminum members each having a horizontal playing surface and a pair of base legs each having a foot section with an outwardly facing wedge-shaped edge. The upper deck section is attached to the I beam superstructure underneath by a plurality of clamps. A double clamp is employed from above to bridge the foot portions of the upper deck sections. The double clamps are connected by a threaded bolt and nut combination to single clamps which are attachable to the wedge-shaped edges of the transverse underlying I beams. The construction of the double clamps is such that the upper deck sections are separated from each other by a predetermined gap suffficient to allow acces to the space between the deck plates. Each court also includes a spring-loaded sidewall and a diagonal external support which is connected to one of the extended underlying I beams. The structure described is relatively inexpensive to manufacture, simple to erect and easy to maintain.

7 Claims, 26 Drawing Figures

Fig. 4A.
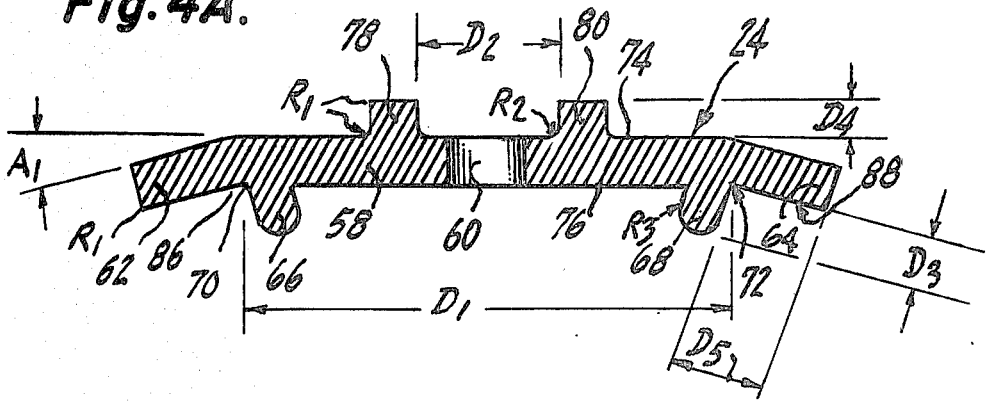
Fig. 4B.
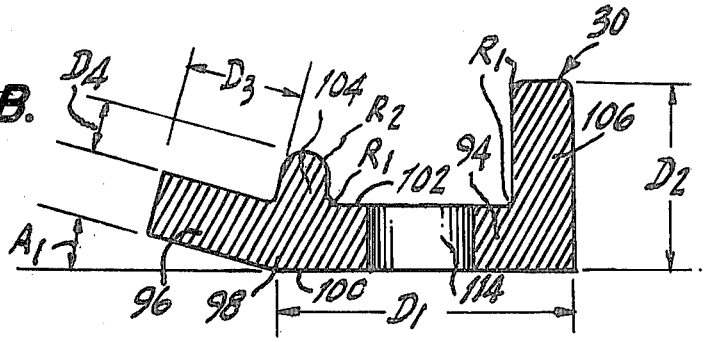
Fig. 4C.
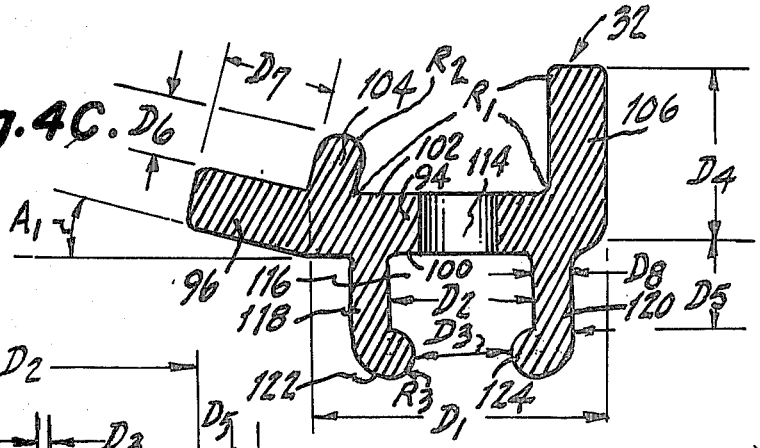
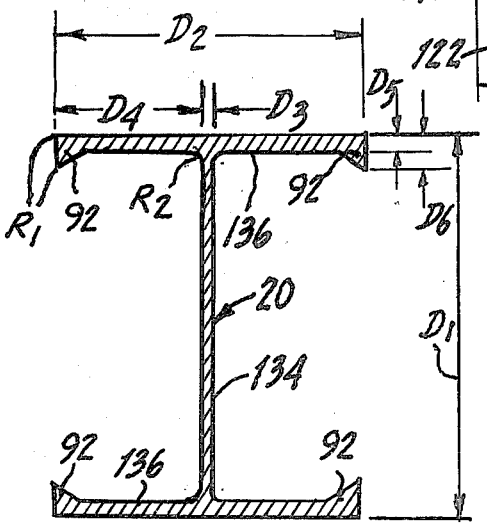
Fig. 5.
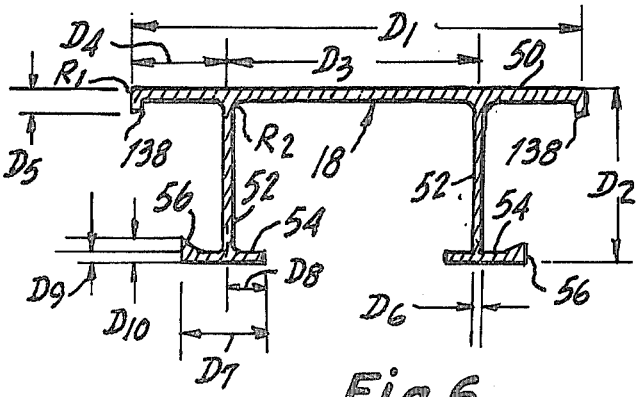
Fig. 6.

Fig.7.
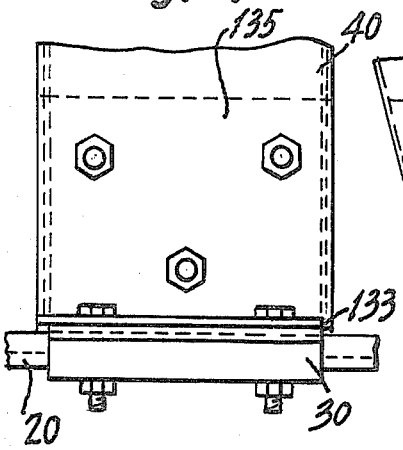
Fig.8.
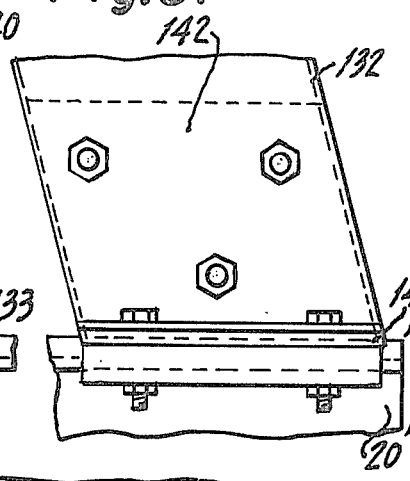
Fig.9.
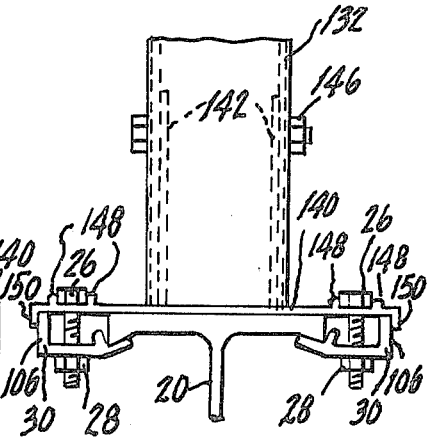
Fig.10.
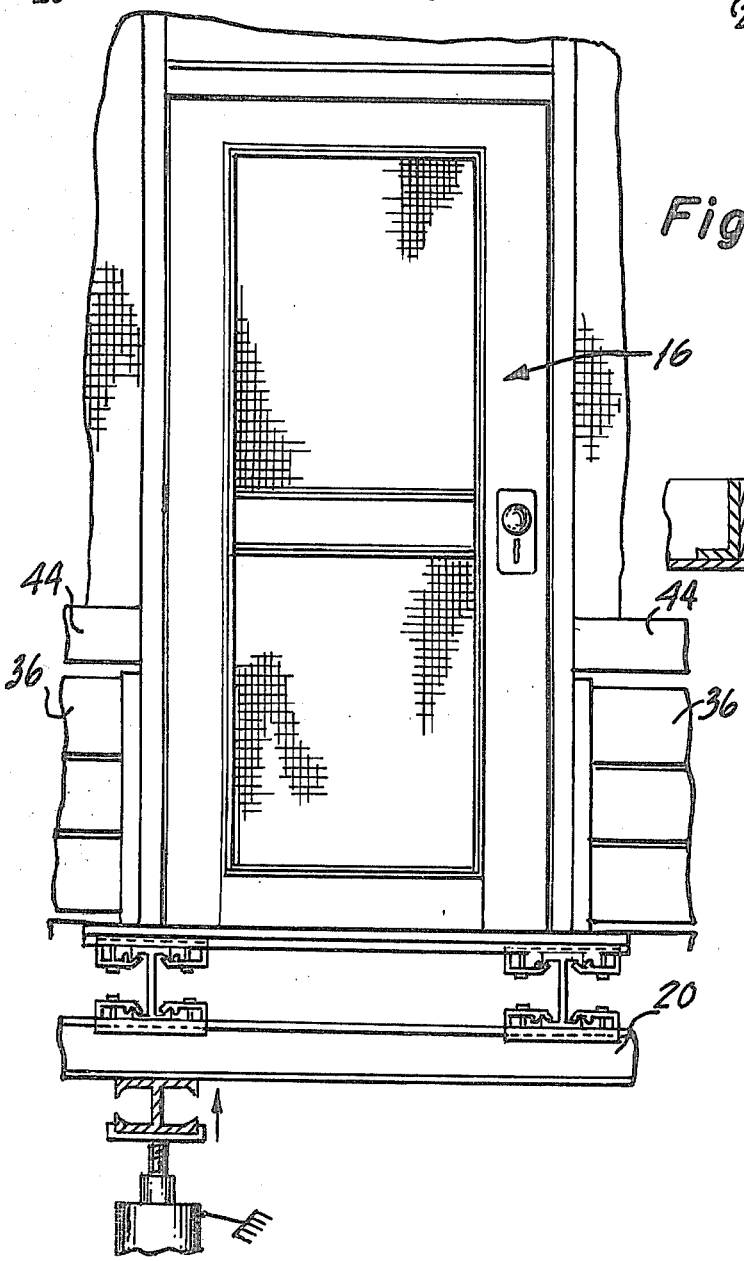
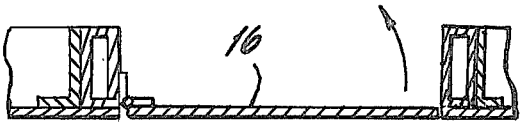
Fig.11.

Fig. 13.
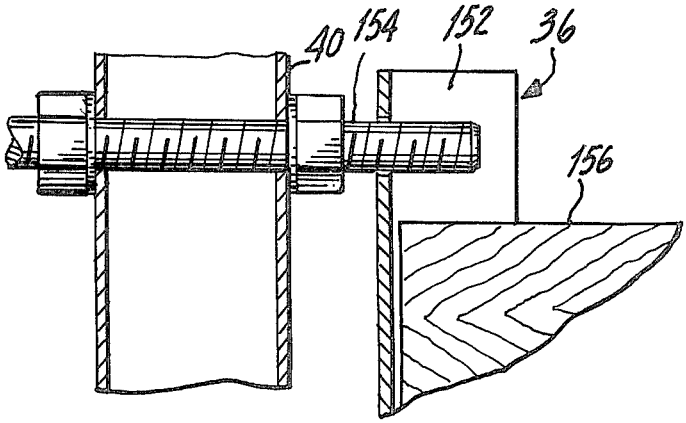
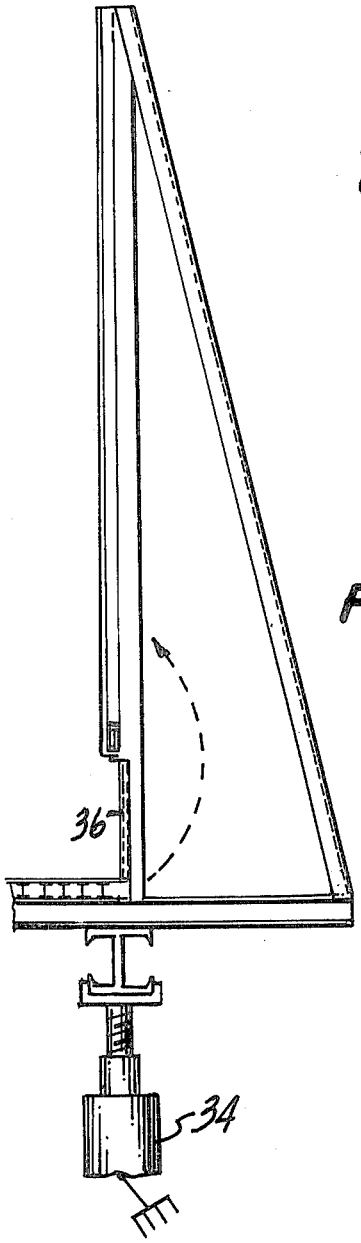
Fig. 12.
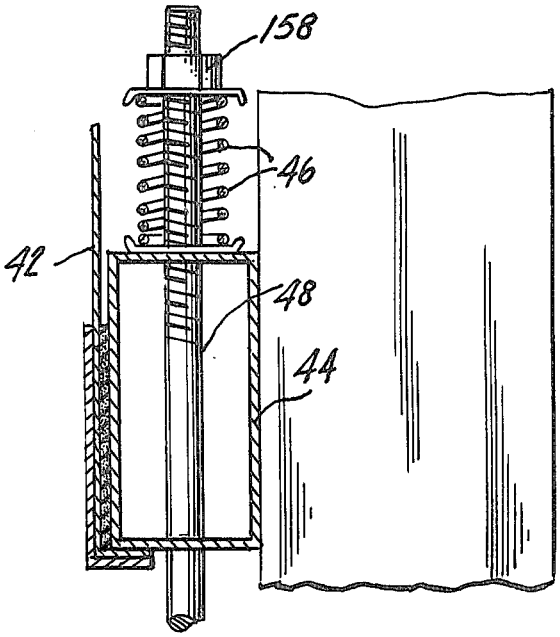
Fig. 14.

PADDLE TENNIS COURT AND DECK CONSTRUCTION

BACKGROUND OF THE INVENTION

1. Field of the Invention

This invention relates to a paddle tennis court in general and in particular to the construction of the deck of said court.

2. Description of the Prior Art

Paddle tennis has become increasingly popular in the United States over the last several years. Accordingly, there has been increased interest in the manufacture of paddle tennis courts. To be commercially successful, a paddle tennis court has to be inexpensive to manufacture, relatively simple to erect and easy to maintain.

The prior art discloses a variety of different court constructions. U.S. Pat. No. 3,383,108 issued on May 14, 1968 to R. J. Reilly, Jr. discloses a Paddle Tennis Court having a wooden deck. Likewise, U.S. Pat. No. 2,205,398 issued on June 25, 1940 to H. V. Eaton, II, discloses a forerunner of the modern court.

One of the major features of any paddle tennis court is the deck. There are several prior art references related to portable floors and decks. One such early disclosure is U.S. Pat. No. 1,546,130 issued on July 14, 1925 to J. H. Hannay.

The preferred embodiment of the invention comprehends the use of modified I beams as supporting members for the deck surface structure. The I beams and deck surface structure are connected together through a series of clamps. Insofar as can be determined, the structure of the present invention is no where disclosed or suggested by the prior art. However, there are some prior art references which do relate to connecting I beam-like members together. For example, French Pat. No. 1,254,372 to Keller discloses in FIGS. 2 and 4 thereof, a structure for connecting I beams together. Specifically, the Keller patent discloses I beams having depressions therein for engagement with interlocking elements 22 and 24.

U.S. Pat. No. 2,976,823 to Dodge is of interest in that it discloses a clamp structure 18 having a foot 20 and a channel portion 15.

Other possibly relevant U.S. Pat. Nos. are the following: 406,048 to Kinnear; 555,981 to Streeter; 1,367,683 to Bentley; 2,080,916 to Hayden; 2,813,310 to Harrison; 2,820,613 to Schilling; 3,062,339 to Geyser; 3,203,151 to Bransford, Jr.; 2,848,088 to Tofanelli and 2,071,865 to Parsons. Of possible interest also is Italian Pat. No. 606,942 issued to Tito Navarrini.

SUMMARY OF THE INVENTION

Briefly described the invention comprises a paddle tennis court having an improved deck construction. The surface of the deck includes a plurality of extruded plates each supported by a pair of leg members having a foot with an outwardly facing wedge-shaped edge. The deck plates are preferably supported by a plurality of transverse I beams, each having a wedge-shaped edge on the extremities of the I beam arms. The deck plates are attached to the underlying I beams by a plurality of double clamp spacers. Each double clamp serves two functions. The first function is to separate adjacent deck plates from one another by a predetermined amount so as to leave a small gap between adjacent plates. The gap allows for drainage and also provides for access to the double clamp. The second function of the double clamp is to secure the deck plate structure to the underlying I beam superstructre. The double clamp is preferably connected through a bolt to a single clamp which engages the wedge-shaped edge of the underlying transverse I beam. A second set of I beams may be located directly below the first set of deck supporting I beams and angled perpendicularly with respect thereto. The two sets of I beams are preferably connected to each other by a pair of opposing single edge clamps connected by a nut and bolt combination. There are two types of single edge clamps. The first type provides for accessibility of a nut or a bolt from the non-clamping side of the clamp. The second type includes an additional nut retaining channel so that a bolt may be threaded into the nut without having to hold the nut by some other additional tool.

The sidewalls of the paddle tennis court are supported by a series of diagonal braces. The base of each diagonal brace is connected to an extension of one of the underlying I beams by a base plate and single edge clamp combination. The sidewall construction of the paddle tennis court incorporates a plurality of hinged snow gates for removing snow and debris from the surface of the court. Immediately above the snow gates is a spring-loaded sidewall adapted to harmlessly absorb the shock of player impact.

These and other features of the invention will be more fully appreciated with reference to the following drawings and the detailed description of the invention.

BRIEF DESCRIPTION OF THE DRAWINGS

FIG. 4A is a cross-sectional view of one of the double deck clamps.

FIG. 4B is a cross-sectional view of one embodiment of a single I beam edge clamp.

FIG. 4C is a cross-sectional view of a second embodiment of an I beam clamp including a channel for engaging the nut of a nut and bolt combination.

FIG. 5 is a cross-sectional view of a modified I beam.

FIG. 6 is a cross-sectional view of the deck section extrusion.

FIG. 7 is a detail view of the manner in which the sidewall post supports are attached to the underlying I beam superstructure.

FIG. 8 is a detail side view of the manner in which the diagonal sidewall braces are attached to an extended I beam.

FIG. 9 is an end view of the detail view shown in FIG. 8.

FIG. 10 is an elevational view of the door structure.

FIG. 11 is a partial top plan view of the door structure illustrated in FIG. 10.

FIG. 12 is a cross-sectional view of a snow gate and the spring-loaded sidewall.

FIG. 13 is a cross-sectional detail view of the hinging mechanism of the snow gate.

FIG. 14 is a detail view of the spring-loaded mechanism associated with the snow gate illustrated in FIG. 12.

DETAILED DESCRIPTION OF THE INVENTION

During the course of this description like numbers will be used to illustrate like elements according to the different views of the invention.

Figure 1:
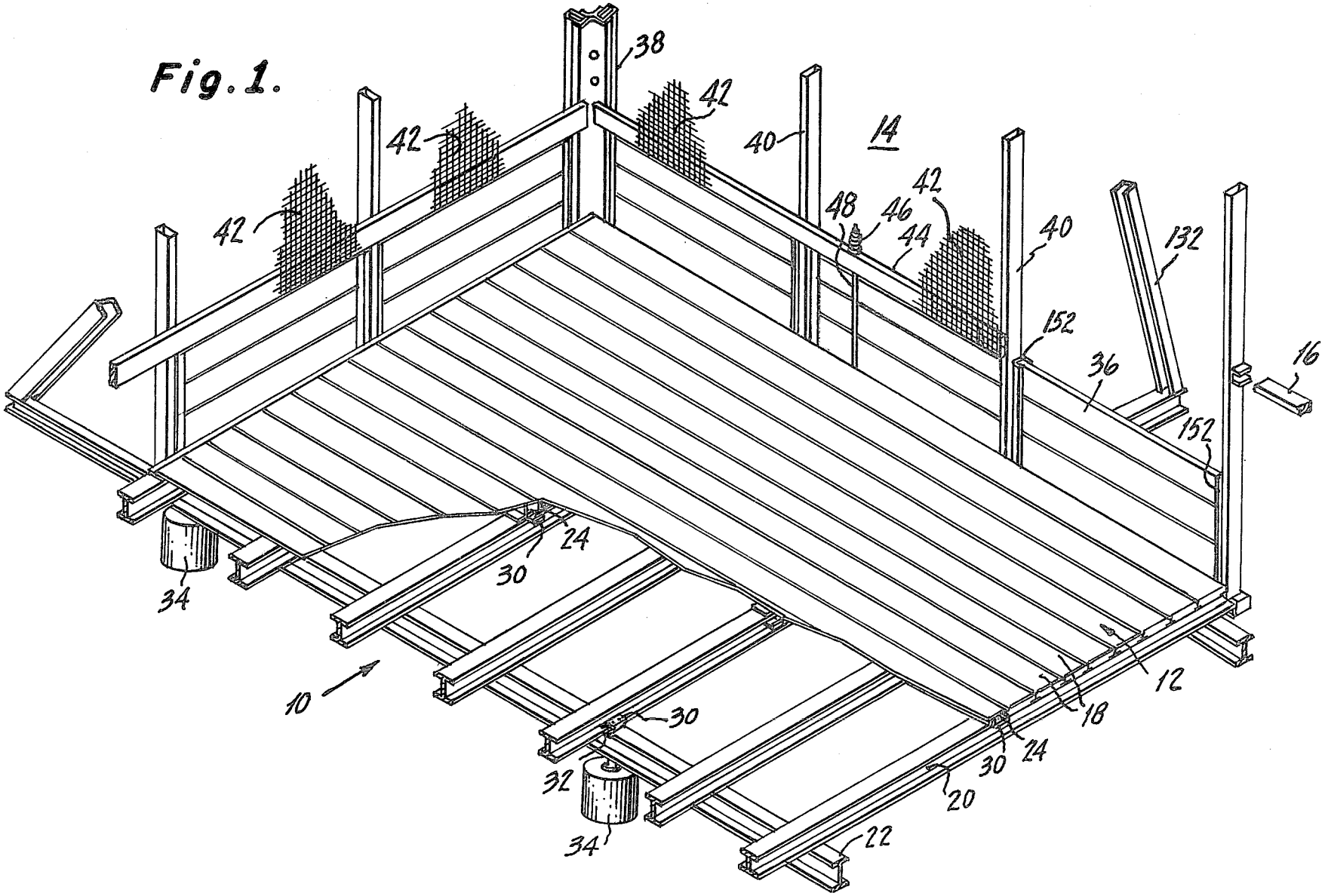
FIG. 1 is a partial perspective cutaway view of the court according to the preferred embodiment of the invention.

The paddle tennis court 10 of the present invention is illustrated in a partial perspective cutaway view in FIG. 1. It is not necessary to illustrate the complete erected court according to the present invention because the details can be better understood from the other figures.

As seen in the accompanying Figures, the court 10 comprises a deck 12, a sidewall 14 and a door 16. The deck 12 includes a plurality of parallel deck plates 18 which are supported by a plurality of transverse I beams 20. I beams 20 in turn are supported underneath by at least a pair of similar I beams 22 which themselves run perpendicular to the length of I beams 20. The deck plates 18 are separate from one another by a plurality of double deck clamps 24 so that there is a gap of approximately 5/16 of an inch between the playing surfaces of the individual deck plates 18. The double deck clamps are connected via a threaded bolt 26 and nut 28 combination to a single edge clamp 30 which engages the edge of one of the underlying I beams 20. Likewise the I beam superstructure 20 is connected to the transverse lower I beam support structure 22 by a plurality of single edge clamps 30 and 32 connected together by a nut 28 and bolt 26 combination.

The bottom set of I beams 22 are supported and leveled by strategically located "wet-set" leveling jacks 34.

Each of the short side sidewalls 14 include four snow gates 36. Each of the long sidewalls 14 include six snow gates 36, three on each side of a center door 16. The sidewall 14 is supported by a plurality of vertical corner supports 38 and intermediate vertical supports 40. The snow gates 36 are located either between the corner supports 38 and the intermediate supports 40 or between two intermediate supports 40. Snow gate 36 is adapted to rotate outwardly to facilitate the removal of snow and debris. It may be constructed either from wood or from suitable aluminum extrusions.

Sidewall 14 also includes a chicken wire mesh 42 attached at the top and bottom thereof. The bottom portion of the chicken wire is attached to a horizontal beam 44 which is connected through a spring mechanism 46 to a vertical rod 48. The spring and rod combination 46 and 48 tend to spring load the fencing wire 42 in such a fashion as to absorb impact. Details of the snow gate 36 and the sidewall construction 42, 44, 46 and are discussed infra.

Paddle tennis tends to be a winter sport. One of the advantages of the present invention is that the court 10 may be dismantled in the summer and re-erected in the winter. For example, it is possible to erect the court 10 over areas such as swimming pools and outdoor tennis courts which are not used in the winter and whose space would otherwise be unutilized. This feature of the invention is especially attractive for country clubs and the like which have a minimum amount of free space.

Figure 2C:
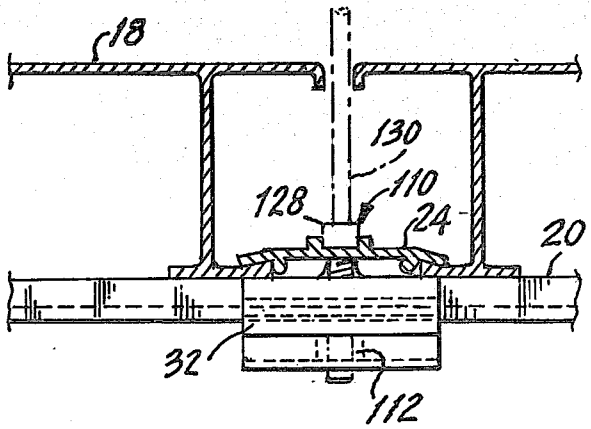
FIG. 2C is a cross-sectional view of another mode of attaching a double deck clamp to an underlying I beam superstructure wherein the threaded member comprises a bolt having a hex head and wherein the single I beam clamp includes a nut engaging channel therein.
Figure 2B:
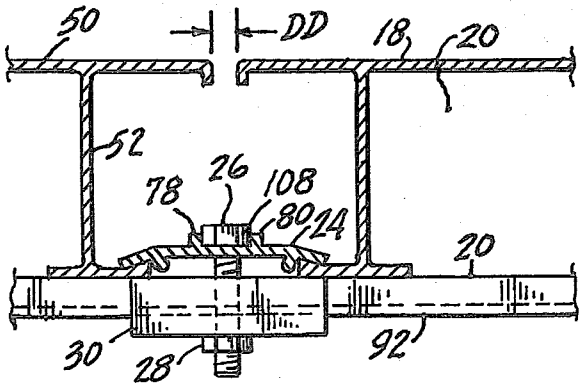
FIG. 2B is a cross-sectional view illustrating the manner in which a double deck clamp may be connected to an I beam superstructure by means of a single edge clamp and a nut and bolt combination.
Figure 2A:
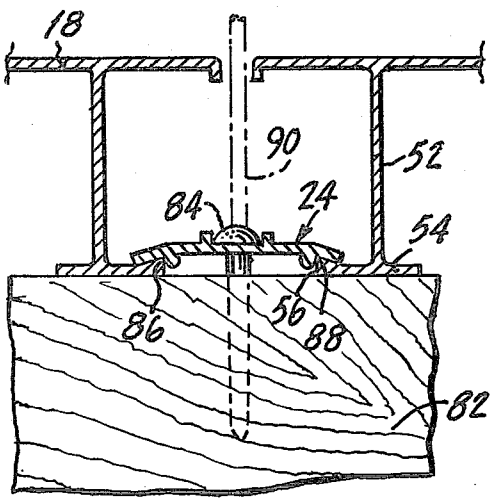
FIG. 2A illustrates the manner in which a double deck clamp may be attached to a wooden superstructure by means of a wood screw.

Details of the deck construction will be more fully appreciated by referring to FIGS. 2A through 6. FIGS. 2A through 2C illustrate three different ways in which a double deck clamp 24 may be attached to an underlying support. Each of the deck extrusions 18 include an upper horizontal surface 50, a pair of vertical leg sections 52 and a foot portion 54 including an outwardly expanding wedge shaped edge 56. The wedge-shaped edge 56 is engaged by the double edge clamp 24 and secured to the underlying structure by a suitable attaching means.

FIG. 4A illustrates in detail the structure of double edge clamp 24. Each double edge clamp 24 includes a substantially horizontal body section 58 having an aperture 60 therethrough. A first and a second edge engaging lip 62 and 64 are located on opposite sides of body section 58 and are inclined at approximately 15° with respect thereto. A first rib 66 is located near the junction 70 of the first edge engaging lip 62 and the body section 58. Similarly a second rib 68 is located at the junction 72 between the second edge engaging lip 64 and the body section 58. The body section 58 includes an upper surface 74 and a lower surface 76. Ribs 66 and 68 are located on the bottom surface 76. A third and fourth rib 78 and 80 are located on the top surface 74 and straddle both sides of aperture 60.

Double edge clamp 24 is seen in an end view in FIG. 4A. It has a length of approximately 5" and preferably includes the following other dimensions:

$D_1$—1.500";
$D_2$—0.520";
$D_3$—0.188";
$D_4$—0.125";
$D_5$—0.312";
$R_1$—0.030";
$R_2$—0.015";
$R_3$—0.060";
$A_1$—15°;
Alloys 6063-T5;
Estimated Area—0.340 sq. inches;
Estimated Weight per ft.—0.408 lbs.
Estimated Perimeter—5.843".

FIG. 2A illustrates a specific manner in which the decking members 18 may be attached to a wooden superstructure 82 through the use of a double deck clamp 24 and a wood screw 84. The first rib 66 forms a first edge engaging pocket 86 with respect to the first edge engaging lip 62. Similarly, the second rib 68 forms a second edge engaging pocket 88 with respect to the second edge engaging lip 64. One major advantage of the present invention is that it reliably sets the distance DD between adjacent deck plates 18 by separating the adjacent deck plates 18 by a predetermined amount. According to the preferred embodiment of the invention the gap DD between adjacent deck plates 18 is approximately 5/16". Wood screw 84 is preferably a #14×2LG self tapping Phillips head screw, however, it will be understood by those skilled in the art that other types of wood screws may also be employed to perform the same function. FIG. 2A shows how the shaft 90 of a Phillips head screwdriver may have access to the head of the wood screw 84 through the predetermined gap DD. Therefore, with a wooden deck superstructure, it is possible to clamp and unclamp the double edge clamps 24 from above in the manner just described.

FIG. 2B illustrates the preferred mounting procedure which should be used where possible. As shown in FIG. 2B, the double edge clamp 24 is connected by a bolt 26 and a nut 28 combination to a single I beam edge clamp 30 which engages the edge 92 of transverse I beam 20. The wedge-shaped edge 92 of the I beam 20 is similar in nature to the wedge-shaped edge 56 of the deck plate 18. Details of the single edge clamp 30 will be more fully understood with reference to FIG. 4B. The single edge gripping clamp 30 includes a substantially horizontal body section 94 and an edge engaging lip 96 attached to the body section 94 at a junction 98. Body section 94 has a lower surface 100 and an upper interior surface 102. A rib 104 is located at the interior angle between edge engaging lip 96 and surface 102. An aperture 114 passes between surface 100 and 102. There is an angle of approximately 15° between the edge engaging lip section 96 and the body section 94. A vertical leg 106 attached to the body section 94 on the opposite side thereof from the edge engaging lip section 96. There is an angle of approximately 90° between the body section 94 and the leg 106. Leg 106 acts like a pivot arm and surface 30 acts as a pivot point when the single edge clamp 30 is connected by a bolt or other means to structure underneath. The pivot action causes the pocket formed between lip section 96 and body section 94 to firmly engage wedge-shaped edge 92. The single edge clamp 30 also has the other following dimensions.

$D_1$—0.906";
$D_2$—0.549";
$D_3$—0.312";
$D_4$—0.188";
$R_1$—0.030";
$R_2$—0.060";
$A_1$—15°;
Alloy 6063-T5;
Estimated Area—0.320 sq. inches;
Estimated Weight per foot—0.384";
Estimated Perimeter—3.911";
Length approximately 2.000".

The bottom mount illustrated in FIG. 2B is preferable because it is easier to erect the deck if the area underneath the deck 18 is accessible. However, if the paddle tennis court 10 is erected over an open swimming pool, it may not be possible to obtain convenient access to bottom nut 28. One important feature of the double edge clamp 24 is that ribs 78 and 80 are adapted to grip the head 108 of the bolt 26 so as to prevent it from turning when the nut 28 is threaded upwardly from below. In other words, the distance between upper ribs 78 and 80 is smaller than the largest diameter of head 108, but larger than the smallest diameter between the flats on the head 108. Bolt 26 preferably comprises a hex head cap screw ¼"=20×1⅜ LG member. The bottom mount just described is preferable because it takes less time to construct in this mode and there is more room to maneuver if the underside of the deck 12 is accessible.

FIG. 2C illustrates an alternative method of attaching the double edge clamp 24 to the I beam superstructure 20. This is the so-called top mount method of construction and should be used only where necessary. Such a method might be necessary where it is impossible or impractical to approach the deck 12 from beneath. In this alternative mode, the deck clamp 24 is connected by a bolt 110 and a nut 112 to a single edge clamp 32 which is adapted to engage the wedge-shaped edge 92 of the underlying I beam superstructure 20. FIG. 2D is an end view of the method of attachment illustrated in FIG. 2C and FIG. 4C illustrates in detail the structure of the edge clamp 32. Edge clamp 32 is virtually identical in structure to edge clamp 30 except that it also includes a nut engaging channel located between a first and second nut engaging rib section 118 and 120 respectively. The first nut engaging rib section 118 includes a lip 122 which faces inwardly towards the nut engaging channel 116. Likewise, the second nut engaging rib section 120 includes a second inwardly facing rib section 124. Lips 122 and 124 face each other so as to contain nut 112. The distance between the inwardly facing surfaces of rib sections 118 and 120 is less than the largest outside diameter of nut 112. However, the same distance is larger than the distance between two opposite flats on the same nut. The spacing between the closests points on the inward surfaces of lips 122 and 124 is smaller than the smallest minimal diameter of nut 112 so as to prevent the nut from inadvertently falling out of nut engaging channel 116. For the sake of continuity, the structural elements that the single edge clamp 32 has in common with single edge clamp 30 have been designated with identical numbers.

The following are the preferred dimensions of the single edge clamp 32:

$D_1$—0.906";
$D_2$—0.450";
$D_3$—0.312";
$D_4$—0.549";
$D_5$—0.250";
$D_6$—0.188";
$D_7$—0.312";
$D_8$—0.090";
$R_1$—0.030";
$R_2$—0.060";
$R_3$—0.045";
$A_1$—15°;
Alloys 6063-T5;
Estimated Area—0.355 sq. in.
Estimated Weight per ft.—0.426 lbs.
Estimated Perimeter—5.527";
Approximate Length—2.000".

Bolt 110 preferably comprises a socket head cap screw ¼"−20×1⅜ LG. Nut 112 preferably comprises an ESLOK #10080. A collapsible plastic collar 126 may be located on the shank of bolt 110. The plastic collar 126 can be helpful to keep the brackets spaced apart and to keep tension on the members prior to screwing down. In practice it has been found, however, that the collapsible plastic collar 126 is not absolutely necessary or desirable under all circumstances. The head 128 of bolt 110 is adapted to accept the blade of a hex screwdriver 130 which is illustrated in phantom in FIG. 2C. The operation illustrated in FIG. 2C it not preferable because it is more time consuming and there is less space in which to maneuver.

Figure 2E:
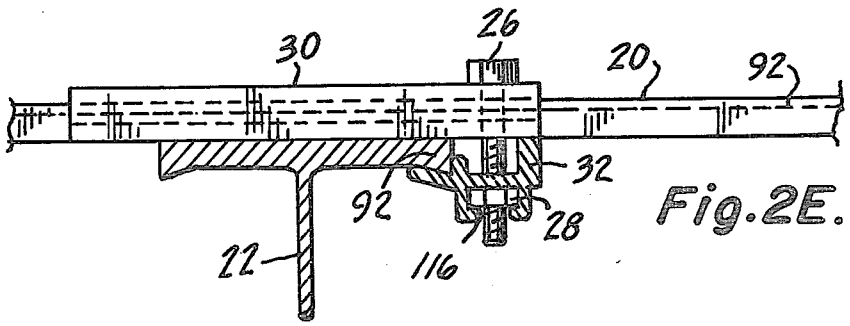
FIG. 2E shows in partial cross-sectional view a detail of the I beam to I beam clamp system employing a pair of single clamps.
Figure 2D:
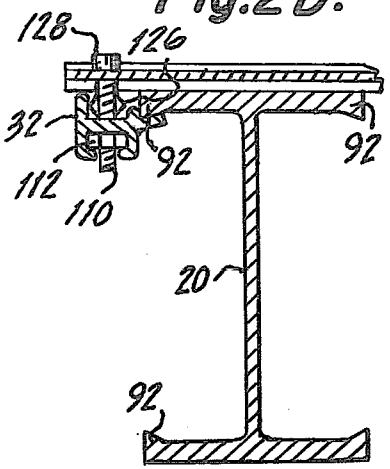
FIG. 2D is a partial cross-sectional view of the double clamp arrangement illustrated in FIG. 2C.

FIG. 2E illustrates in detail the manner in which the deck supporting I beams 20 are attached to the underlying I beam supports 22. One important feature of the invention is that the same single edge clamps 30 and 32 employed to connect the decking 18 to the I beam superstructure 20 may also be used to connect the deck supporting I beams 20 to the underlying I beam supports 22. As shown in FIG. 2E, a single edge clamp 30 of the first embodiment is employed to engage the wedgeshaped edge 92 of I beam 20. A hex head cap screw 26 passes through the aperture in edge clamp 30 and is received in the aperture in the underlying edge clamp 32. Edge clamp 32 in turn engages the edge 92 of the underlying I beam 22. Note that edge clamps 30 and 32 are transverse to each other when mounted. Nut 28 is engaged in channel 116 in the same manner that nut 112 is engaged in channel 116 as illustrated in FIGS. 2C and 2D. This particular feature is important because it allows the same single edge clamps to be utilized in different portions of the deck thereby cutting down upon the number of different parts necessary to erect the paddle tennis court 10.

The double edge clamps 24 can be considered to be universal in the sense that they may be employed to attach the decking plates 18 to a variety of underlying superstructures through a variety of different connecting members such as wood screws, bolts or socket head screws. The ribs 66 and 68 are important for several reasons. First of all, they help form pockets 86 and 88 which receive the wedge-shaped edges 56 of the decking 18. The downwardly sloping pockets 86 and 88 compliment the upwardly turned edges 56 so that as the clamping plate 24 is forced downwardly the edges 56 will be drawn inwardly until they abut against ribs 66 or 68. In this manner a fixed, predetermined spacing of approximately 1.500" is established between the edges 56 of adjacent deck sections 18. Accordingly, a gap of approximately 5/16" is established between the adjacent upper surfaces 50. Another advantage of ribs 66 and 68 is that they prevent the clamp 24 from turning while the device is being attached to the underlying superstructure.

Figure 3A:
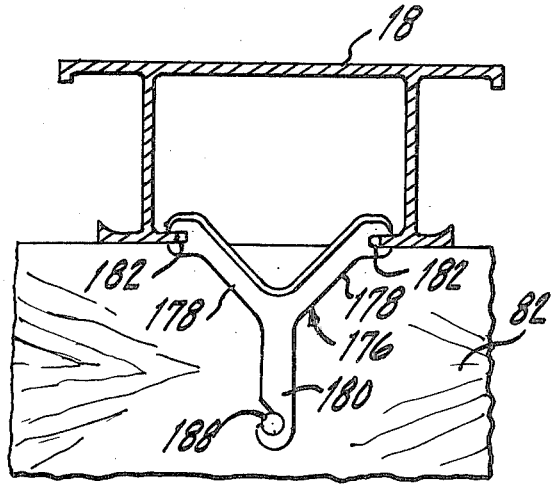
FIG. 3A is a front elevational view of an alternative Y-shaped deck clamp used to connect deck plates to a wooden superstructure.

An alternative method for connecting a deck plate 18 to the wooden beam 82 in the underlying superstructure is illustrated in FIG. 3A. According to the alternative method a Y-shaped clamp is employed to engage the interior edges of the foot sections 54 of the deck plates 18 and connect them directly to the underlying wooden beam structure 82. Each Y clamp 176 includes a pair of arms 178 and a common body section 180. Each arm in turn includes a groove 182 adapted to engage the interior edge of the foot sections 54. The body section 180 includes an oval shaped, partially hollow aperture 184 which is adapted to receive a nail 188 or similar fastening device. The clamp 176 has an outer face 186 and an inner face 190 which makes contact with the outside face of an underlying wooden beam 82. The long axis of grooves 182 and aperture 184 are inclined at an angle of approximately 15° with respect to surfaces 186 and 190 as may be seen in FIG. 3E. Aperture 184 is oval in cross-section so as to better accomodate nail 188.

Figure 3C:
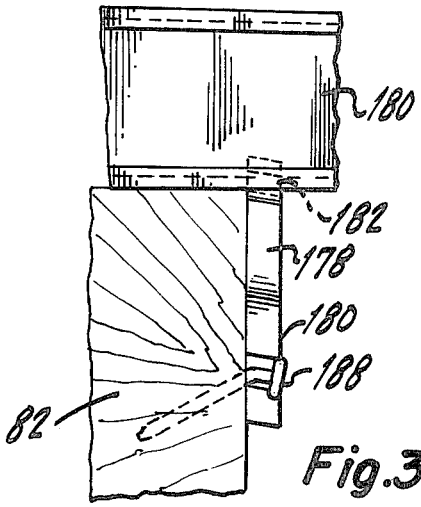
FIGS. 3B and 3C illustrate the method by which the Y-shaped clamp shown in FIG. 3A is employed to fasten a deck plate to a wooden beam.
Figure 3B:
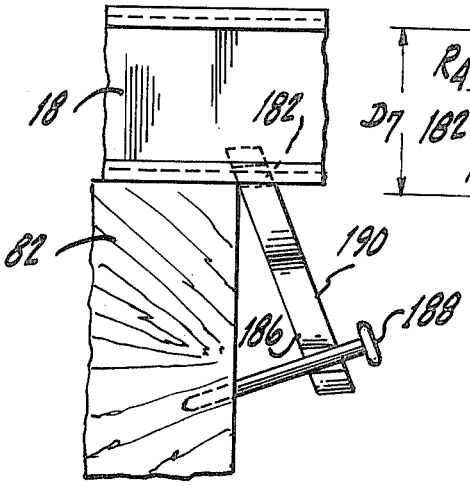
Figure 3D:
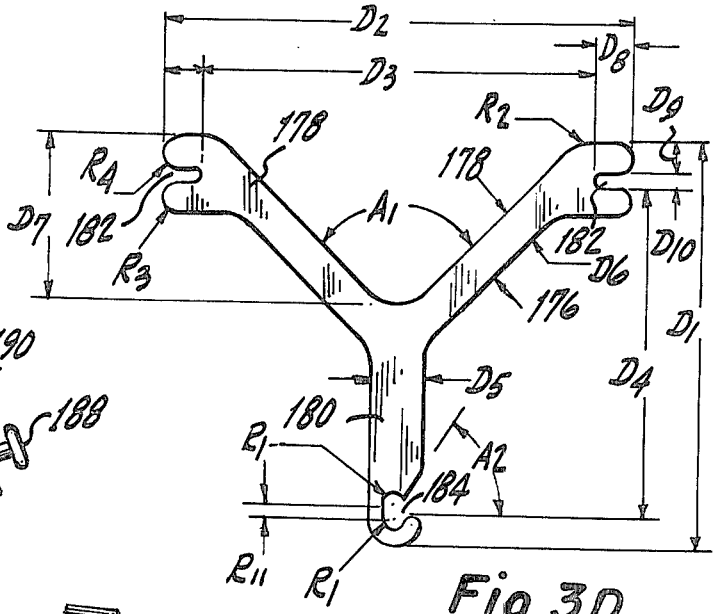
FIG. 3D is a view of one face of the Y-shaped clamp illustrated in FIG. 3A as seen from a perspective parallel to the side surfaces of the clamp.
Figure 3E:
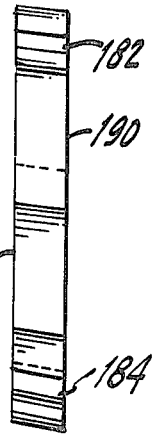
FIG. 3E is a side elevational view of the Y-shaped clamp illustrated in FIG. 3A.

FIG. 3D illustrates the Y-shaped clamp 176 as seen from a direction parallel to the side surfaces of the clamp. Clamp 176 is formed by extruding aluminum through a die having the shape illustrated in FIG. 3D and then cutting the extrusion into short lengths on a bias which is approximately 15° from a line perpendicular to the long dimension of the extrusion. Accordingly, the die used to form the extrusion has the same general shape and configuration as the view of the Y-shaped clamp 176 illustrated in FIG. 3D.

FIGS. 3B and 3C illustrate the manner in which the Y-shaped clamp 176 is employed to fasten the deck plates 18 to wooden members 82. First the grooves 182 of the clamp 176 are placed over the interior edges of the foot sections 54 so that they loosely engage the interior edges thereof. Second, a nail 188 is placed through oval aperture 184 in the manner illustrated in FIG. 3B. Third and finally, the nail is driven home in the manner illustrated in FIG. 3C. During the course of the operation the groove 182 impinges upon and bends the interior edges of the foot section 54. This causes the arms 178 to firmly engage the deck plate 18. By properly angling the nail during the hammering operation it is possible to pull downwardly on the Y-shaped clamp 176 thereby improving its purchase upon the deck plates 18. It is desirable that the aperture 184 be oval so as to prevent the nail 188 from being seized by clamp 176 during the construction of the court.

As a general proposition, it is preferable not to perform extensive fabrication on the large I beams or deck plates. That is because a typical extrusion comes in 30 ft. lengths. By using Y-shaped clamps 176 it is possible to attach the deck plates 18 directly to the wooden superstructure without having to drill holes through the deck plates 18 or without requiring any significant additional fabrication.

Typical dimensions for the Y-shaped clamp 176 illustrated in FIG. 3D are as follows:

| | | | |
|---|---|---|---|
| $D_1$ - 2.675" | $D_6$ - 0.240" | $R_1$ - 0.075" | $A_1$ - 90° |
| $D_2$ - 3.100" | $D_7$ - 1.120" | $R_2$ - 0.250" | $A_2$ - 60° |
| $D_3$ - 2.600" | $D_8$ - 0.250" | $R_3$ - 0.125" | Alloy 6063-T6 |
| $D_4$ - 2.200" | $D_9$ - 0.200" | $R_4$ - 0.060" | Est. Area-1.500 sq. in. |
| $D_5$ - 0.350" | $D_{10}$ - 0.100" | | Est. wt./ft.-1.800 lbs. |
| | | | Est. perimeter-12.2 in. |

A typical I beam 20 according to the preferred embodiment of the present invention is illustrated in detail in FIG. 5. The I beam includes a vertical center portion 134 and a pair of head sections at either end 136. The ends of each of the opposite head sections 136 are terminated in edges 92 which expand outwardly. The preferred dimensions of I beam 20 are as follows:

| | | |
|---|---|---|
| $D_1$ - 5.000" | $D_5$ - 0.361" | $A_1$ - 15° |
| $D_2$ - 3.000" | $D_6$ - 0.361" | Alloy 6061-T6 |
| $D_3$ - 0.125" | $R_1$ - 0.030" | Est. Area - 2.339 sq. in. |
| $D_4$ - 1.438" | $R_2$ - 0.250" | Est. Weight per ft. - 2.807 lbs. |
| | | Estimated Perimeter - 21.38" |

A deck plate 18 according to the preferred embodiment of the invention is illustrated in detail in FIG. 6. As previously described, the deck 18 includes a horizontal playing surface 50, a pair of vertical leg sections 52 and a pair of foot sections 54 each attached respectively to the pair of leg sections 52. Each foot section includes at least one wedge-shaped clamping edge 56 which is flared outwardly and adapted to be received in the clamping pockets 86 and 88 of the double deck clamp 24. The edges of the upper surface 50 are terminated in over-hanging lips 138. The preferred dimensions of deck 18 are as follows:

$D_1$—6.083";
$D_2$—2.250";
$D_3$—3.563";
$D_4$—1.260";
$D_5$—0.250";
$D_6$—0.075";
$D_7$—1.063";
$D_8$—0.438";
$D_9$—0.090";
$D_{10}$—0.180";
$R_1$—0.060";
$R_2$—0.090".
Wall Thickness—0.065 unless otherwise specified.
Brake at Sharp Corners—0.010" unless otherwise specified.
Estimated Cross-sectional Area—0.971 sq. in.
Estimated Weight per ft.—1.165 lbs.
Estimated Perimeter—25.36"

The sidewalls 14 of the deck 10 are supported by a plurality of vertical supports 38 and 40 and diagonal braces 132. The manner in which the upright supports 38 and 40 and the diagonal brackets 132 are attached to the deck superstructure are illustrated in detail in FIGS. 7 through 9. In FIG. 7 a vertical support member 40 (or 38) is attached by a plate 133 and a pair of single edge clamps 30 and extension of the I beam superstructure 20.

FIG. 8 illustrates the manner in which the diagonal braces 132 are attached to I beam 20 through the use of a similar base plate 140. The only difference between base plates 133 and 140 is that the interior ears 142 are slightly canted in the case of base plate 140 and are vertical (see element 135) in the case of base plate 133. Vertical supports 38 and 40 are preferably hollow members.

FIG. 9 is an end view of the base support 140 illustrated in FIG. 8. However, it could just as easily be an end view of the support system illustrated in FIG. 7. The base plate 140 includes a pair of internal ears 142, previously described, which are bolted to the base of diagonal brace 132 by a bolt 26 and nut 28 combination. Base plate 140 includes two pairs of bolt engaging ribs 148 which are adapted to immobilize the heads of locking bolts 26. Each base plate 140 is terminated on opposite ends by an overhanging, downwardly directed lip 150. The bolt 26 is connected to a single edge clamp 30 by a nut 28. Overhanging lip 150 is important because it prevents the vertical leg 106 of the single edge clamp 30 from slipping beyond the edge of the base plate 140 and allows the clamp to pivot safely around leg 106. Lip 150 also prevents the clamp from turning or rotating off of base plate 140. In this manner the downwardly directed lip 150 acts as a tab to prevent the undesired movement of the edge clamp 30 during tightening.

The invention preferably comprehends four vertical corner supports 38 and eighteen intermediate vertical supports 40. Some of the vertical supports 38 and 40 extend above the sidewall 14 and act as standards to support night lights. There are six vertical supports 40 on each side of the longest dimension of the court and three vertical supports 40 between the two corner supports 38 on the short dimension of the court. Therefore there are six snow gates 36 on each of the long sides of the court and four snow gates on each of the short sides of the court. One of the bays between the intermediate verticle supports 40 on each of the longest sides of the court will be taken up by a door 16. Details of the door construction may be understood with reference to FIGS. 10 and 11. The structure of the door is such that it is compatible with the other materials.

Additional details of the snow gate 36 can be readily understood from FIGS. 12 and 13. Snow gates 36 preferably comprises a pair of opposing channels 152 which are hung by a pivot rod 154 from either a vertical corner support 38 or a vertical intermediate support 40. A series of wooden planks 156 are received in channels 152 and serve as the surface of snow gate 36. Alternatively, extruded aluminum sections may be substituted for wooden panels 156. The arc illustrated in phantom in FIG. 12 illustrates the manner in which the snow gates 36 may be pivoted out of the way in order to clean the surface of the court 10.

One problem with paddle tennis is that the playing space is rather confined. Accordingly, it is not uncommon to make a good deal of contact with the sidewalls 14 during play. Because the fencing wire 42 may or may not be elastic in nature, the impact of a player upon the sidewall 14 may be permanently damaging to the structure or the player. A preferred solution to this problem is to spring load the sidewalls 14 in such a manner that a player impacting upon the sidewall 14 will not significantly damage the sidewall 14 or himself. FIG. 14 illustrates in greater detail the manner in which the sidewall 14 may be spring loaded. As previously described, the wire fence 42 is connected by an appropriate means to a horizontal bar 44. Bar 44 is not rigidly connected to the structure but is relatively free to move upwards and downwards by a limited amount. Bar 44 is connected through spring mechanism 46 to a rod 48. The other end of rod 48 is connected to the superstructure of the deck. The tension on the spring-loaded mechanism and screen 42 may be adjusted by changing the position of nut 158. Accordingly, impact upon the screen 42 will be absorbed by spring 46 in such a manner as to eliminate or greatly minimize any possible damage to the fence 42 or the player.

Figure 15:
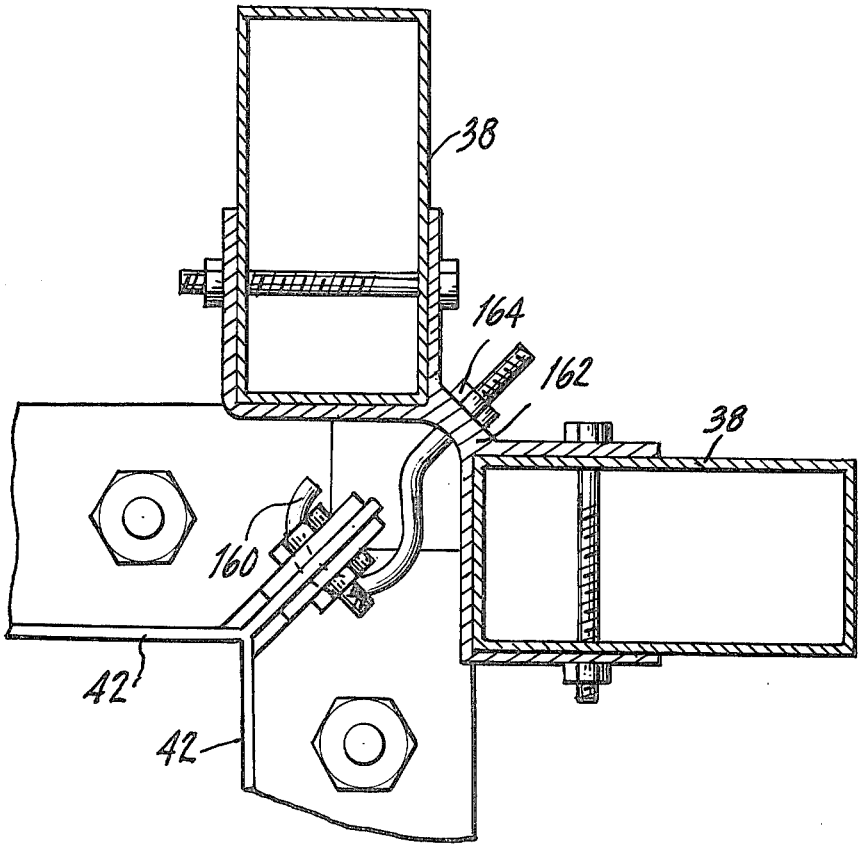
FIG. 15 is a partial cross-sectional view of the tensioning arrangement on the sidewall screens.

The horizontal edges of the fence 42 are connected to the vertical corner supports 38 by means of a hook 160 as shown in FIG. 15. The hook 160 is attached to the corner bracket 162 by a nut 164. Therefore the horizontal tension on the fence 42 may be adjusted by turning tension nut 164.

Figure 16:
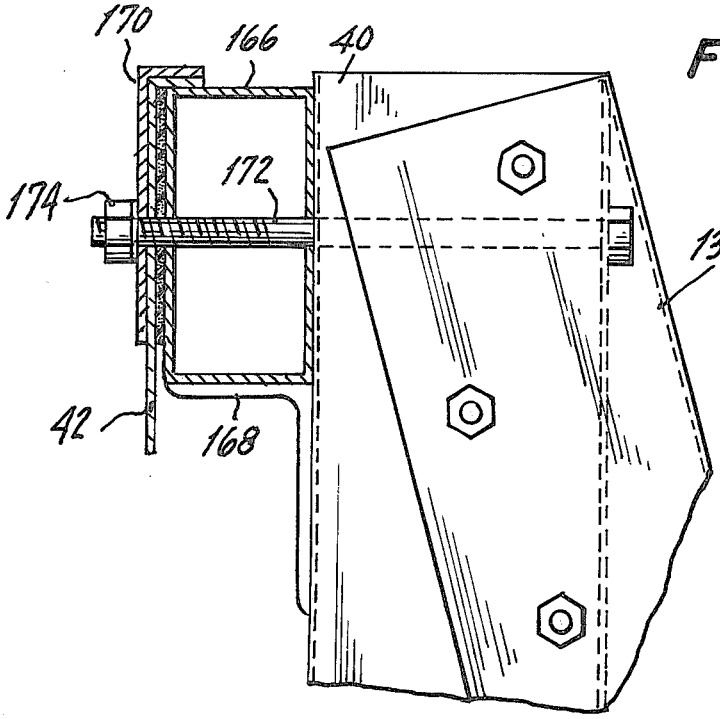
FIG. 16 is a detail view of the manner in which the diagonal deck supports are attached to the top of the sidewalls.

FIG. 16 illustrates in detail the manner in which the diagonal braces 132 are connected to the top of vertical supports 38 or 40. The wire fence 42 is set off from the vertical supports 38 or 40 by a horizontal spacer beam 166 which is connected to the vertical support 38 or 40 by a bracket 168. A clamping plate 170 surrounds the top part of the wire fence 42. The wire fence 42 is held against the upper part of the structure by a bolt 172 and a nut 174 which passes through the plate 170, the spacer beam 166 and the vertical support 40.

While the invention has been described with reference to the preferred embodiment thereof, it will be appreciated by those of ordinary skill in the art that various modifications may be made in the parts and structure without departing from the spirit and scope of the invention.

I claim:

1. A deck apparatus comprising:

a plurality of first members having an upper deck surface, a pair of leg sections attached to said upper deck surface and a pair of outwardly facing foot sections attached to said leg sections respectively, said foot sections including a wedge-shaped edge thereon;

a double clamp means including a section thereof for cradling and clamping the wedge-shaped edges of two adjacent first members thereby automatically creating a gap of predetermined dimensions between the upper surfaces of said two adjacent first members, said double clamp means including a body section having at least one aperture therethrough, a first and a second edge engaging lip section attached to said body section and located on opposite sides thereof, said first and said second edge engaging lip sections being inclined with respect to said body section, and a first and a second rib section located respectively adjacent to said first and said second edge engaging lip sections and forming with respect to said first and said second edge engaging lip sections a pocket for engaging the wedge-shaped edges of said two adjacent first members respectively;

threaded means receivable in said aperture in the body section of said double clamp means; and, a plurality of second members running approximately perpendicular to said first members and located under said first members, said second members being attached to said first members by said threaded means and said double clamp means, wherein said threaded means is accessible by a tightening tool through said gap between the upper deck surfaces of said adjacent first members.

2. The apparatus of claim 1 wherein said second members comprise wooden beams and said threaded means comprise wood screws.

3. The apparatus of claim 1 further including:

a third and fourth rib section located on opposite sides of said aperture means and on the side of said body section opposite from said first and second rib sections.

4. The apparatus of claim 3 wherein said second members comprise I beams having wedge-shaped edges thereon, said apparatus further including:

a single edge engaging clamp means having an aperture therethrough adapted to receive said threaded means and including therein a pocket for engaging the edge of one of said second members.

5. The apparatus of claim 4 wherein said single edge engaging clamp means comprises:

a body section having said aperture therethrough;

an edge engaging lip section attached to one side of said body section and inclined with respect to said body section;

a rib section attached to said body section adajacent to said edge engaging lip section and forming with respect to said edge engaging lip section a pocket for receiving the edge of one of said second members; and, a leg section attached to said body section and on the opposite side of said body section from said edge engaging lip section, said leg section being at an angle of approximately 90° with respect to said body section.

6. The apparatus of claim 5 wherein said single clamp means includes a second and third rib thereon which form a channel means for engaging the sides of a nut means receivable on said threaded means.

7. The apparatus of claim 6 further comprising:

a plurality of third members located below said second members and running perpendicular to said second members; and, at least a pair of single clamp means, a threaded means receivable in said pair of single clamp means and a nut means for clamping at least one of said second members to one of said third members.

* * * * *